US009402469B2

(12) United States Patent
Finstad et al.

(10) Patent No.: US 9,402,469 B2
(45) Date of Patent: Aug. 2, 2016

(54) DETACHABLE UTILITY HOLDER FOR TABLE UMBRELLA

(71) Applicants: Amy Sue Finstad, Mora, MN (US); Mark Thomas Finstad, Mora, MN (US)

(72) Inventors: Amy Sue Finstad, Mora, MN (US); Mark Thomas Finstad, Mora, MN (US)

( * ) Notice: Subject to any disclaimer, the term of this patent is extended or adjusted under 35 U.S.C. 154(b) by 0 days.

(21) Appl. No.: 14/544,713

(22) Filed: Feb. 9, 2015

(65) Prior Publication Data

US 2016/0015171 A1 Jan. 21, 2016

Related U.S. Application Data

(60) Provisional application No. 61/999,199, filed on Jul. 18, 2014.

(51) Int. Cl.

| | |
|---|---|
| ***A45B 25/02*** | (2006.01) |
| ***A47B 37/04*** | (2006.01) |
| ***A47B 13/00*** | (2006.01) |
| ***A47B 83/04*** | (2006.01) |

(52) U.S. Cl.
CPC ..... *A47B 37/04* (2013.01); *A47B 13/003* (2013.01); *A47B 83/04* (2013.01)

(58) Field of Classification Search
CPC ... A47B 37/04; A47B 2200/0008; A47B 3/12
USPC ..... 248/225.11, 220.11; 211/133.4, 133.1, 211/196, 197; 108/50.12, 185, 151; 135/16
See application file for complete search history.

(56) References Cited

U.S. PATENT DOCUMENTS

| | | | | |
|---|---|---|---|---|
| 5,335,803 | A * | 8/1994 | O'Brien | A47B 13/14 108/50.12 |
| 7,520,485 | B1 * | 4/2009 | Giannetto | A01K 97/10 173/91 |
| 8,720,349 | B1 * | 5/2014 | David | A47B 37/04 108/151 |
| 2015/0216274 | A1 * | 8/2015 | Akin | A45B 25/00 135/16 |

* cited by examiner

*Primary Examiner* — Todd M Epps

(57) ABSTRACT

Described is a device that can be used to hold a plurality of items such as plates, bowls and glasses on a patio table. The device is attached to the pole of the table umbrella and can be attached or detached in seconds without the use of any tools.

21 Claims, 10 Drawing Sheets

DETACHABLE UTILITY HOLDER FOR TABLE UMBRELLA

FIELD OF THE INVENTION

The present invention relates generally to accessories for a patio table and specifically to a device for holding a plurality of items such as plates, bowls, and glasses that can be easily attached and removed from the pole of a patio table umbrella.

BACKGROUND OF THE INVENTION

Many people have patio tables that they use for eating, drinking, and visiting. Most of these tables are relatively small in size so that they do not take up an undue amount of space on a patio or deck, and they usually have an umbrella for shade. The small size of these tables can be troublesome when food or drinks are being served due to the limited space to set serving items such as plates, bowls, glasses, etc.

This table clutter can also lead to items being either spilled on the table or knocked on to the floor as other items are shuffled around.

It can also be difficult to find space on the table for candles, other light sources, or bug repellant devices when the table is full of eating and drinking items.

Most people will store items that are not being used at the immediate time on an additional table or chair, which is usually out of reach when the items are needed.

One way to reduce the chance of dropping items to the floor would be to have an additional storage area above the table surface to augment the usable table area. This would allow items to be stored within easy reach of any person seated at the table.

This additional storage area could also be used to place candles, lighting devices, or bug repellant devices above the table surface which would reduce the chance of burn injury to persons using the table.

Also, by placing the most frequently needed item on the additional storage area, they would be readily accessible to anyone seated at the table.

SUMMARY OF THE INVENTION

An object of the present invention is to provide a Detachable Utility Holder For Table Umbrella that would add usable space to a patio table.

Another object of the present invention is to provide a Detachable Utility Holder For Table Umbrella that is easy to manufacture.

Another object of the present invention is to provide a Detachable Utility Holder For Table Umbrella that can be easily installed on the table umbrella pole in seconds without the use of any tools.

Another object of the present invention is to provide a Detachable Utility Holder For Table Umbrella that is inexpensive to manufacture Another object of the present invention is to provide a Detachable Utility Holder For Table Umbrella that can be removed in seconds without the use of any tools when the device needs to be cleaned.

Another object of the present invention is to provide a Detachable Utility Holder For Table Umbrella that is safe and easy to use.

DETAILED DESCRIPTION OF THE PREFERRED EMBODIMENTS

Figure 1:
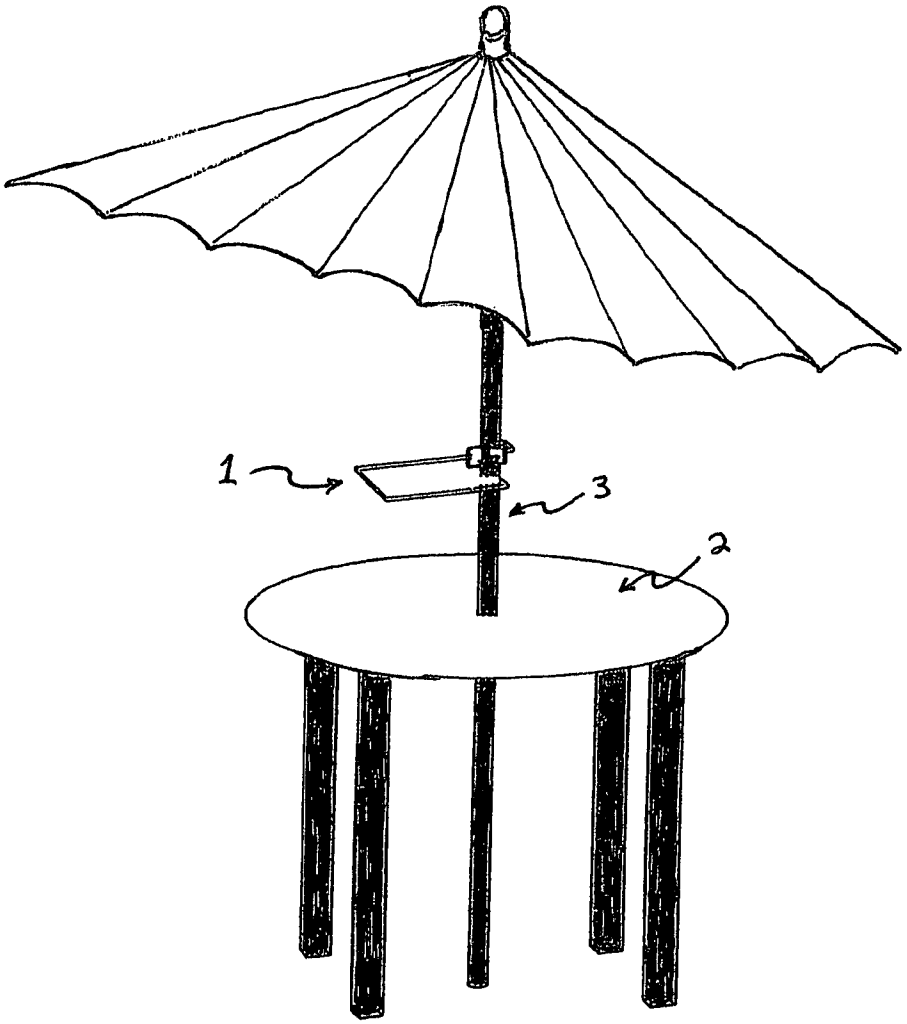
FIG. 1 is northeast isometric view of a DETACHABLE UTILITY HOLDER FOR TABLE UMBRELLA showing patio table and table umbrella.
Figure 2:
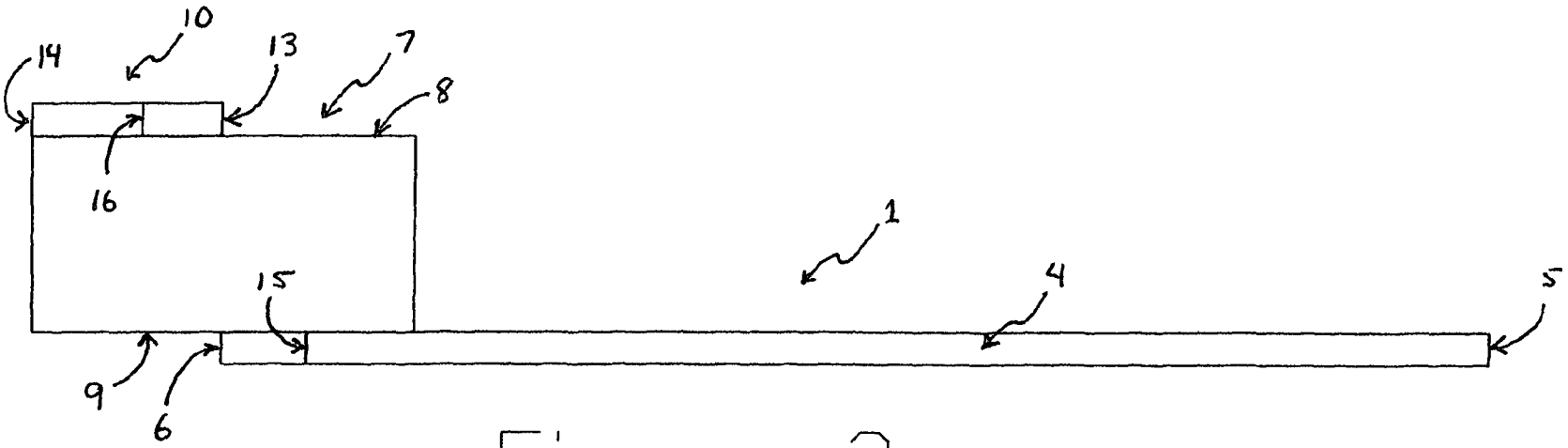
FIG. 2 is a side plan view of the DETACHABLE UTILITY HOLDER FOR TABLE UMBRELLA.
Figure 3:
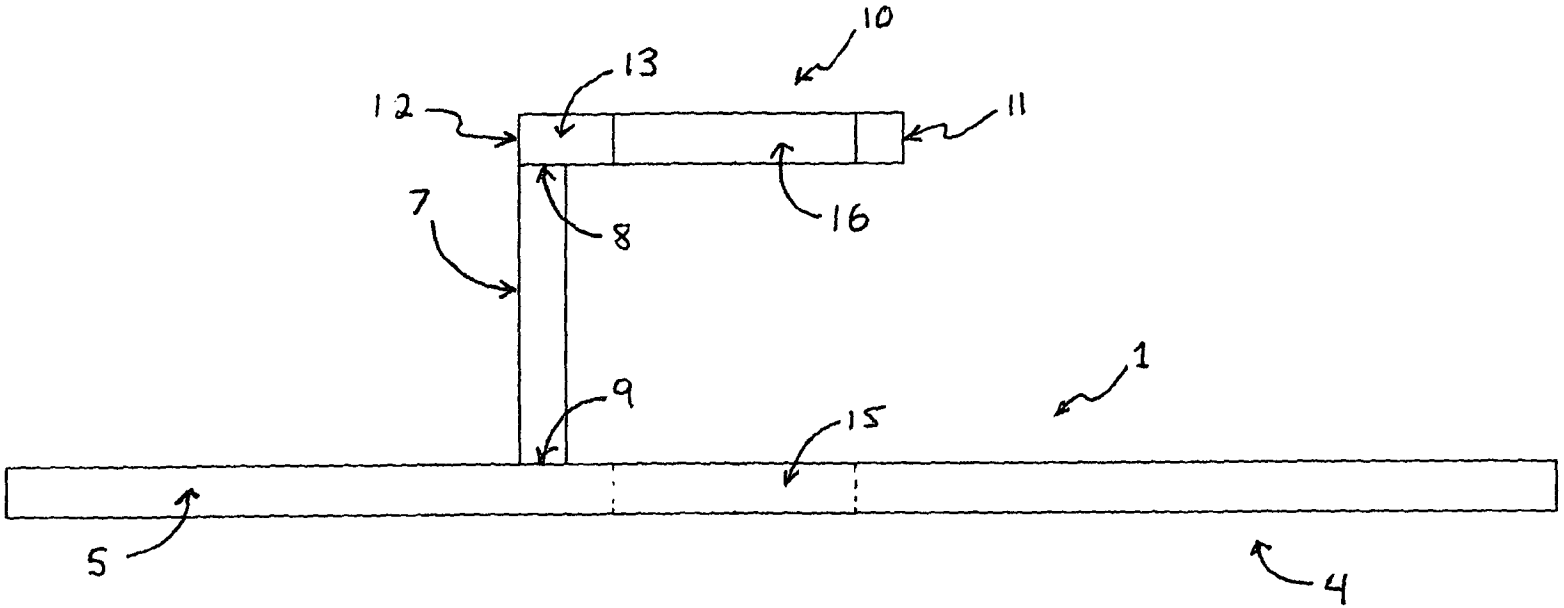
FIG. 3 is a front end plan view of the DETACHABLE UTILITY HOLDER FOR TABLE UMBRELLA.
Figure 4:
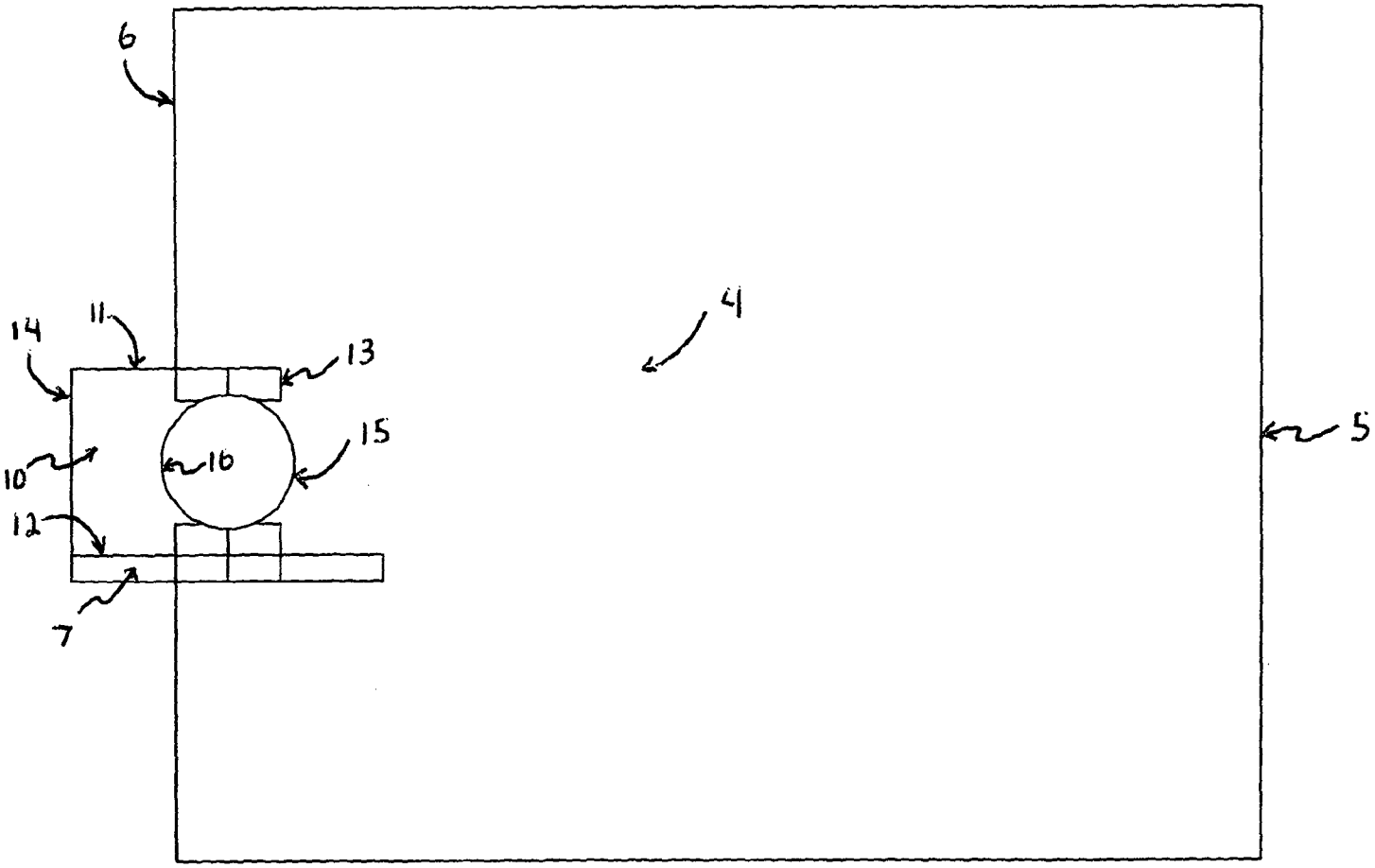
FIG. 4 is a top plan view of the preferred embodiment of the DETACHABLE UTILITY HOLDER FOR TABLE UMBRELLA.
Figure 5:
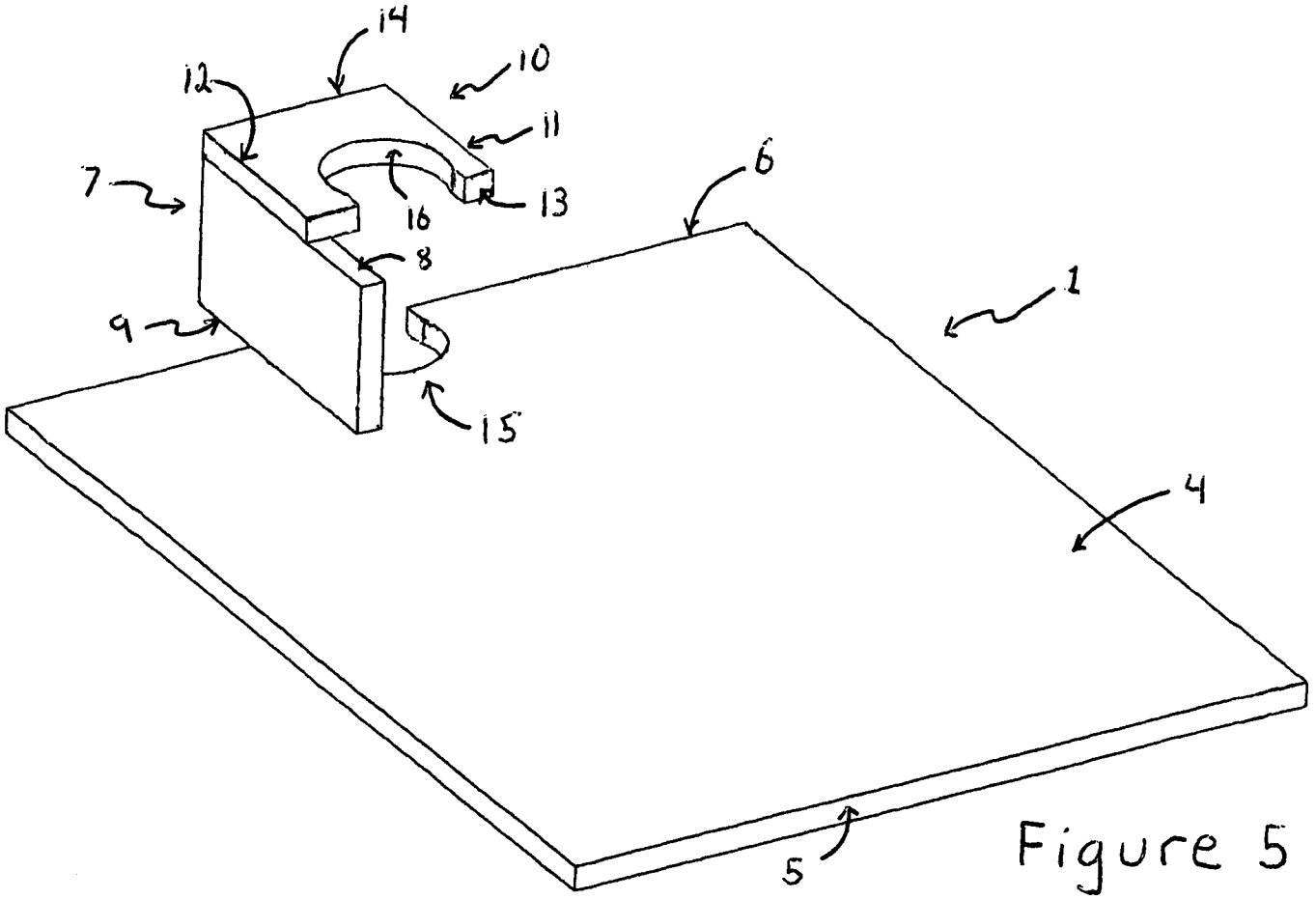
FIG. 5 is northwest isometric view of the preferred embodiment of the DETACHABLE UTILITY HOLDER FOR TABLE UMBRELLA.
Figure 6:
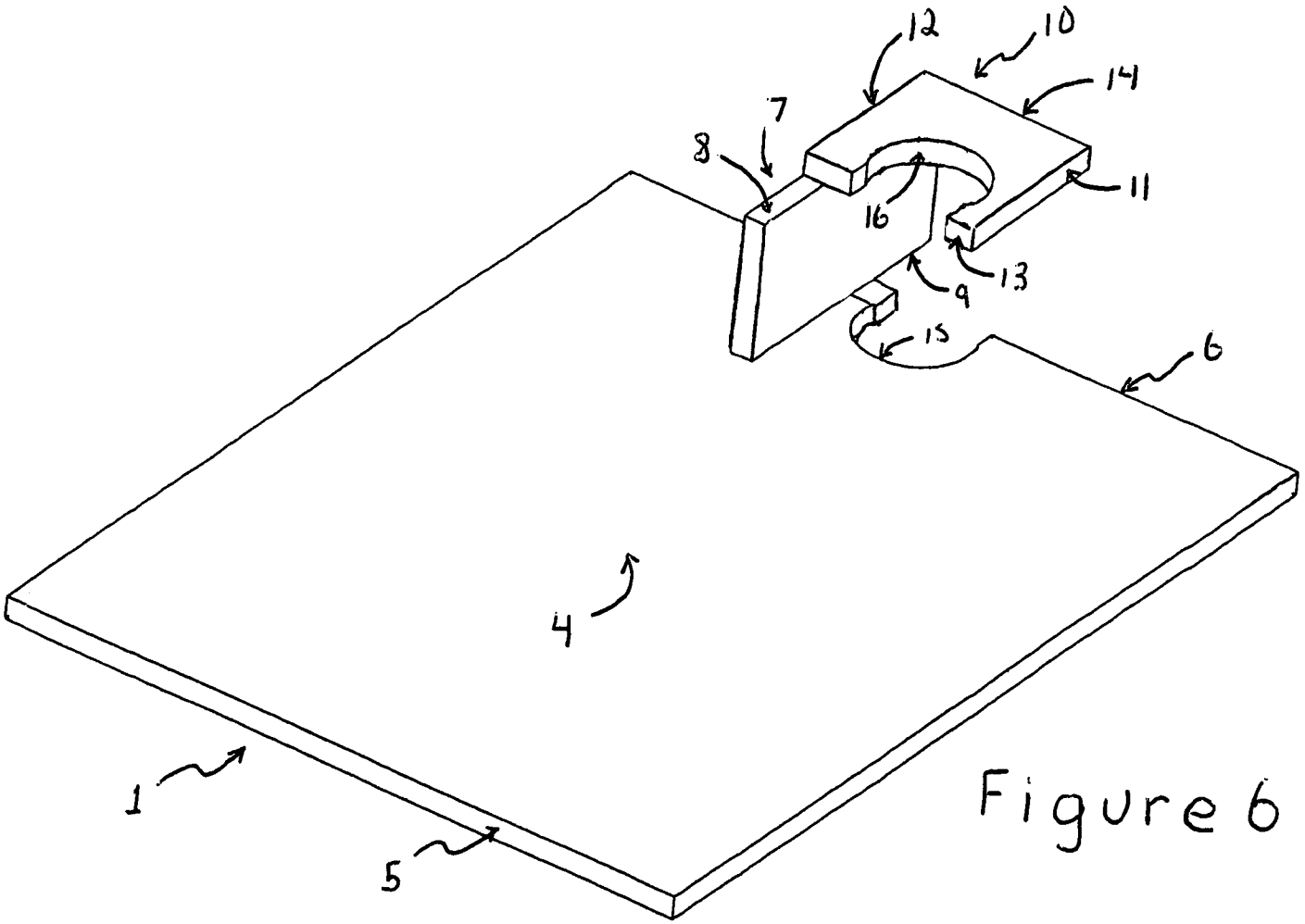
FIG. 6 is northeast isometric view the preferred embodiment of the DETACHABLE UTILITY HOLDER FOR TABLE UMBRELLA.
Figure 7:
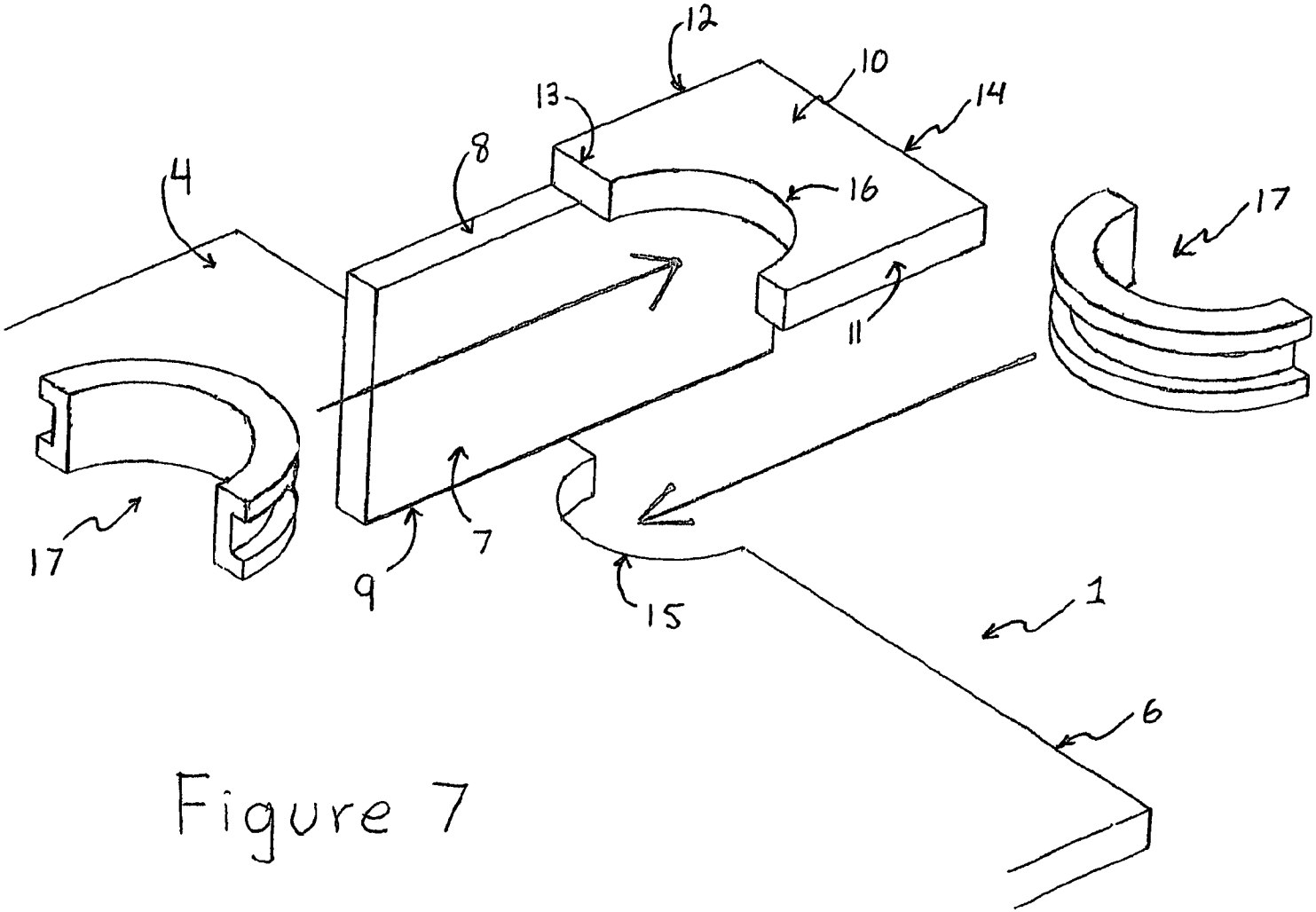
FIG. 7 is a northeast isometric view of the DETACHABLE UTILITY HOLDER FOR TABLE UMBRELLA showing radius cut-out inserts
Figure 8:
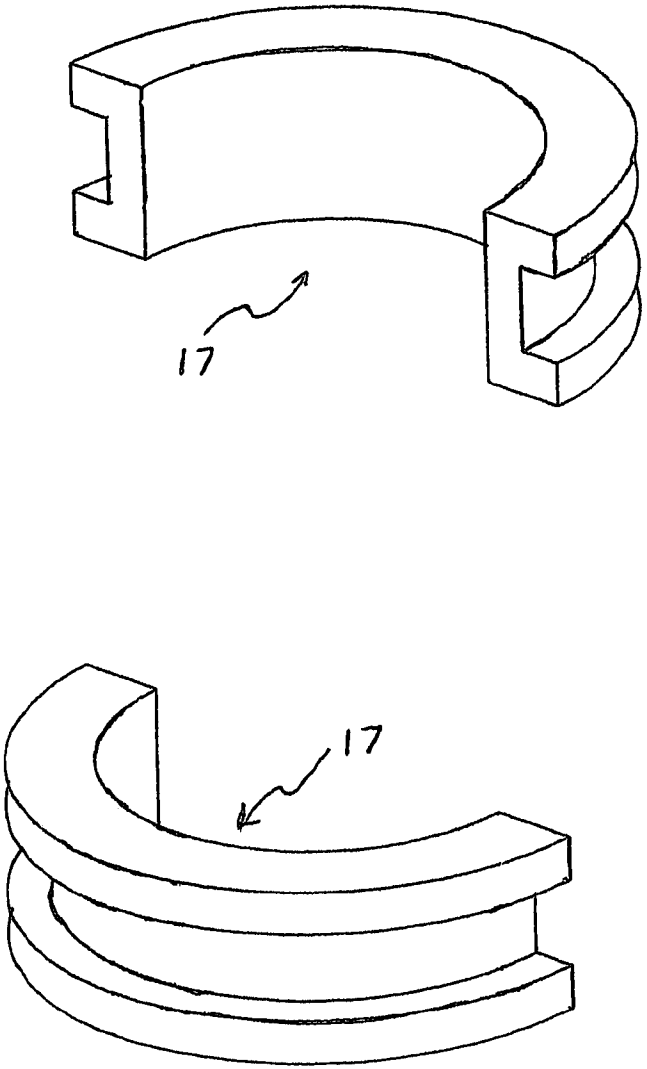
FIG. 8 is an isometric view of the radius cut-out inserts
Figure 9:
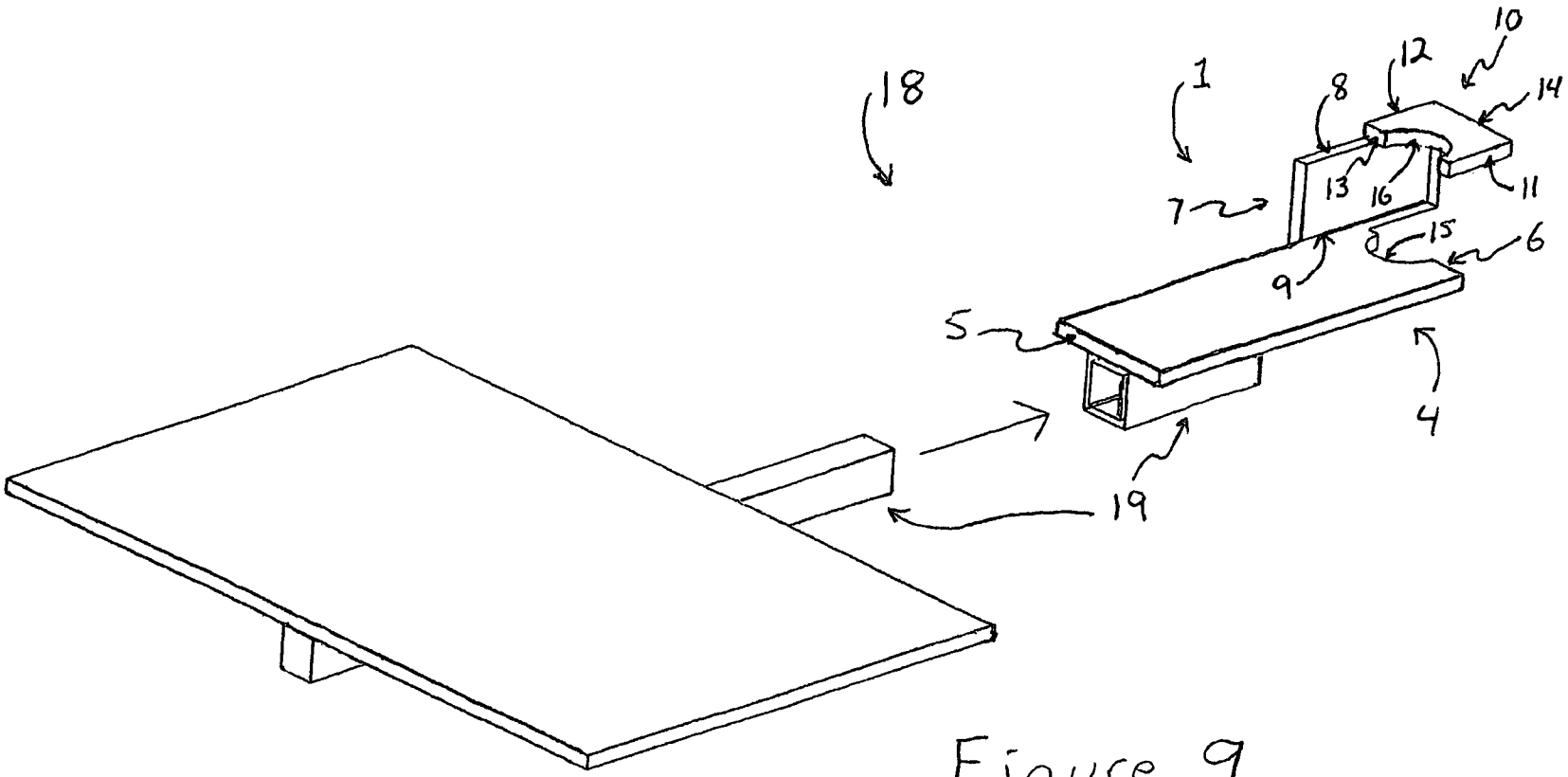
FIG. 9 is northeast isometric view of a DETACHABLE UTILITY HOLDER FOR TABLE UMBRELLA showing alternate embodiment with attachment means for plurality of holding appendages.
Figure 10:
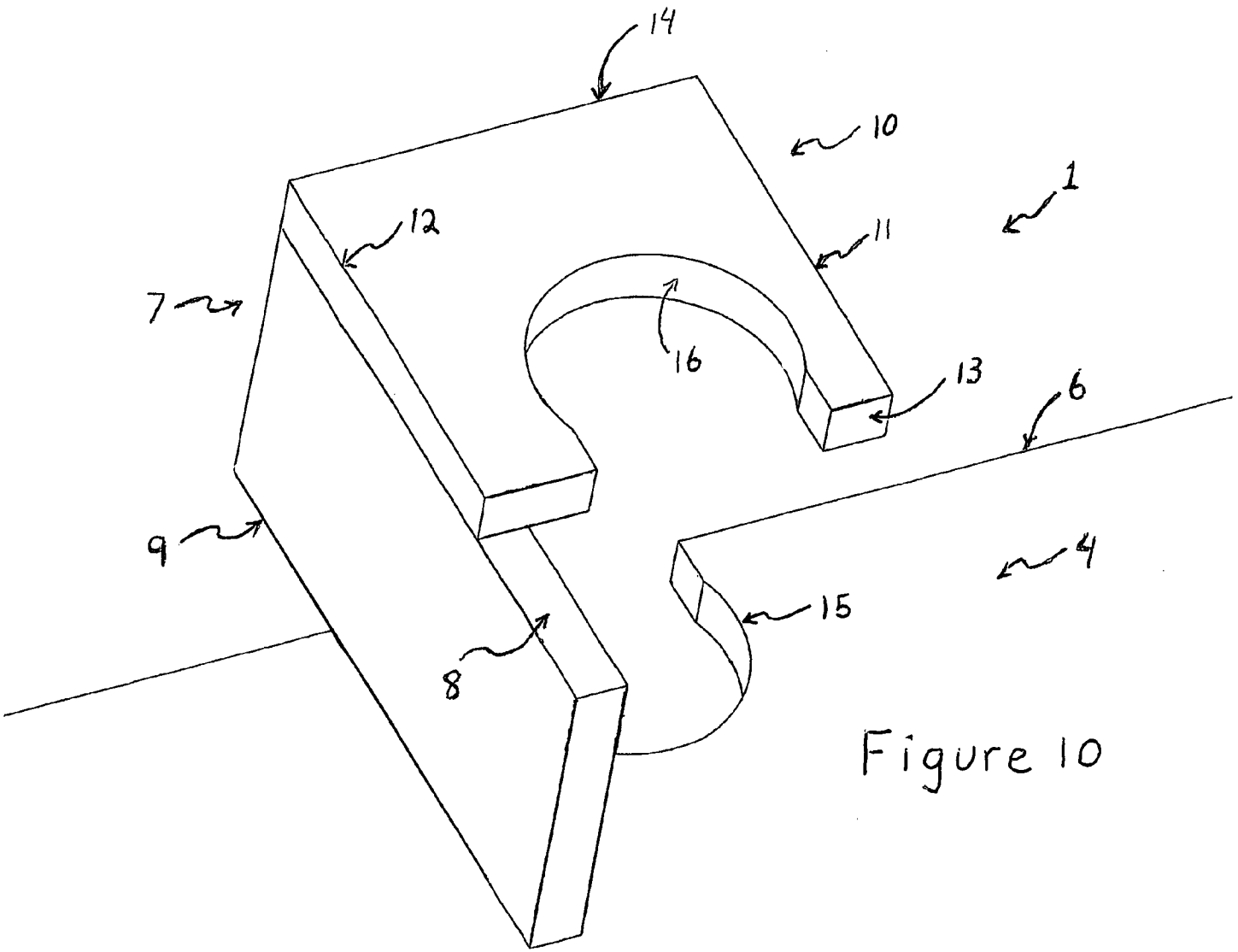
FIG. 10 is a close up northwest isometric view of the preferred embodiment.

The Detachable Utility Holder for Table Umbrella (1) is particularly illustrated in FIGS. 1-7, and 9-10. In the preferred embodiment of the Detachable Utility Holder for Table Umbrella (1), the lower base portion radius cut out (15) and upper retaining portion radius cut out (16) are not coplanar, but are concentric when viewed in the Z axis. The lower base portion radius cut out (15) and upper retaining portion radius cut out (16) are positioned so they are rotated 180 degrees to each other. The planar offset between the lower base portion radius cut out (15) and upper retaining portion radius cut out (16) is equal to, or greater than the diameter of the umbrella pole (3). This feature allows the table umbrella pole (3) to move freely between lower base portion (4) and the top retaining portion (10) during assembly to the umbrella pole (3).

In the preferred embodiment of the Detachable Utility Holder for Table Umbrella (1), the lower base portion radius cut out (15) and upper retaining portion radius cut out (16) have a diameter that is approximately equal to the diameter of the umbrella pole (3).

In the preferred embodiment of the Detachable Utility Holder for Table Umbrella (1), the lower base portion radius cut out (15) and upper retaining portion radius cut out (16) have a radius angle of greater than 180 degrees but less than 250 degrees. This feature will allow the upper retaining portion radius cut out (16) and the lower base portion radius cut out (15) to snap on to the umbrella pole and act as a retention feature. In this embodiment, the top retaining portion front edge (13) and the lower base portion back edge (6) will be slightly off-set and overlapping each other (when viewed in the Z-axis) in order to capture the additional radius angles of the radius cut outs. In a variation of the preferred embodiment, only one of the radius cut outs would have a radius angle greater than 180 degrees and the other radius cut out would have a radius angle approximately equal to or less than 180 degrees.

In an alternate embodiment of the Detachable Utility Holder for Table Umbrella (1), the lower base portion radius cut out (15) and upper retaining portion radius cut out (16) have a diameter that is greater than the diameter of the umbrella pole (3). In this embodiment, radius cut out inserts (17) with inside diameter approximately equal to the diameter of the umbrella pole (3) and outside diameter approximately equal to the diameter of the lower base portion radius cut out (15) and the diameter of the upper retaining portion radius cut out (16) are attached to the lower base portion radius cut out (15) and upper retaining portion radius cut out (16). This feature will allow the Detachable Utility Holder for Table Umbrella (1) to be used on a plurality of umbrella pole diameters by simply changing the radius cut out inserts (17) to match the diameter of the umbrella pole (3).

In a variation of the preferred embodiment (18), the lower base portion front edge (5) of the Detachable Utility Holder for Table Umbrella (1) is configured with a connection means (19) that would accept a plurality of attachments. One possible connection means could be a square, rectangular, or multi-sided tube portion on the lower base portion front edge (5) and a mating square, rectangular or multi-sided mating piece on the plurality of attachments that would be inserted into the aforementioned tube. The square, rectangular or multi-sided configuration of tube/mating parts function to keep the plurality of attachments from unwanted rotation.

In the variation of the preferred embodiment (18), the plurality of attachments could include a table platform or a hook for hanging a light source. The table platform could additionally have slots or holes cut to allow wine glasses or cups to be securely retained.

Having thus described in detail several embodiments of the present invention, it is to be appreciated and will be apparent to those skilled in the art that many physical changes, only a few of which are exemplified in the specification of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than the foregoing description, and all alternate embodiments and changes to this embodiment which come within the meaning and range of equivalency of said claims are therefore to be embraced the

PARTS LIST

1. Detachable Utility Holder for Table Umbrella
2. Patio table
3. Table umbrella pole
4. Lower base portion
5. Lower base portion front edge
6. Lower base portion back edge
7. Middle connecting portion
8. Middle connecting portion top edge
9. Middle connecting portion bottom edge
10. Top retaining portion
11. Top retaining portion right edge
12. Top retaining portion left edge
13. Top retaining portion front edge
14. Top retaining portion back edge
15. Lower base portion radius cut out
16. Upper retaining portion radius cut out
17. Radius cut out insert
18. Alternate embodiment of Detachable Utility Holder for Table Umbrella
19. Connection means of Alternate embodiment of Detachable Utility Holder for Table Umbrella

We claim:

1. A detachable utility holder to be attached to a table umbrella pole comprised of: a lower base portion with front and back edges, a middle connecting portion with top and bottom edges, and a top retaining portion with right and left edges and front and back edges, wherein said lower base portion is substantially planar, said middle portion is substantially planar with distance between said top and bottom edges equal to or greater than a diameter of the table umbrella pole, and said top retaining portion is substantially planar, wherein said bottom edge of middle connecting portion is rigidly connected to the base portion perpendicular to base portion plane and base portion back edge, and wherein said left edge or said right edge of top retaining portion is rigidly connected to said top edge of middle connecting portion perpendicular to said middle portion, and wherein said back edge of base portion contains a first radius cut out with a radius angle greater than 180 degrees but less than 250 degrees, and a diameter of first radius cut out approximately equal to a diameter of an umbrella pole, and wherein said front edge of top retaining portion contains a second radius cut out with radius angle greater than 180 degrees but less than 250 degrees, and a diameter of second radius cut out approximately equal to the diameter of the table umbrella pole, wherein said cut outs are positioned so said cut outs are rotated 180 degrees to each other and are concentric when viewed perpendicular to the lower base portion plane.

2. The detachable utility holder of claim 1 wherein the top retaining portion and middle connecting portion are a single unitary structure.

3. The detachable utility holder of claim 1 wherein the radius angle of only one radius cut out is greater than 180 degrees and the radius angle of other is less than 180 degrees.

4. The detachable utility holder of claim 1 wherein the detachable utility holder is a single unitary structure.

5. The detachable utility holder of claim 1 wherein the detachable utility holder is constructed from plastic.

6. The detachable utility holder of claim 1 wherein the detachable utility holder is constructed from metal.

7. The detachable utility holder of claim 1 wherein the lower base portion between front and back edges form an enlarged planar surface capable of supporting dining items.

8. The detachable utility holder of claim 1 wherein the lower base portion is configured with a tubular female connector that would accept a plurality of attachments having a matching male connector.

9. A detachable utility holder to be attached to a table umbrella pole comprised of: a lower base portion with front and back edges, a middle connecting portion with top and bottom edges, and a top retaining portion with right and left edges and front and back edges, wherein said lower base portion is substantially planar, said middle portion is substantially planar with distance between said top and bottom edges equal to or greater than a diameter of the table umbrella pole, and said top retaining portion is substantially planar, wherein said bottom edge of middle connecting portion is rigidly connected to the base portion perpendicular to base portion plane and base portion back edge, and wherein said left edge or said right edge of top retaining portion is rigidly connected to said top edge of middle connecting portion perpendicular to said middle portion, and wherein said back edge of base portion contains a first radius cut out with radius angle less than or equal to 180 degrees and diameter of first radius cut out equal to or slightly larger than a diameter of an umbrella pole, and wherein said front edge of top retaining portion contains a second radius cut out with radius angle less than or equal to 180 degrees and a diameter of second radius cut out equal to or slightly greater than the diameter of the table umbrella pole, wherein said cut outs are positioned so said cut outs are rotated 180 degrees to each other and are concentric when viewed perpendicular to the lower base portion plane.

10. The detachable utility holder of claim 9 wherein the top retaining portion and middle connecting portion are a single unitary structure.

11. The detachable utility holder of claim 9 wherein the detachable utility holder is a single unitary structure.

12. The detachable utility holder of claim 9 wherein the detachable utility holder is constructed from plastic.

13. The detachable utility holder of claim 9 wherein the detachable utility holder is constructed from metal.

14. The detachable utility holder of claim 9 where the lower base portion between front and back edges form an enlarged planar surface capable of supporting dining items.

15. The detachable utility holder of claim 9 where the lower base portion is configured with a tubular female connector that would accept a plurality of attachments having a matching male connector.

16. A detachable utility holder to be attached to a table umbrella pole comprised of: a lower base portion with front and back edges, a middle connecting portion with top and bottom edges, and a top retaining portion with right and left edges and front and back edges, wherein said lower base portion is substantially planar, said middle portion is substantially planar with distance between said top and bottom edges equal to or greater than a diameter of a the table umbrella pole, and said top retaining portion is substantially planar, wherein said bottom edge of middle connecting portion is rigidly connected to the base portion perpendicular to base portion plane and base portion back edge, and wherein said left edge or said right edge of top retaining portion is rigidly connected to said top edge of middle connecting portion perpendicular to said middle portion, and wherein said back edge of base portion contains a first radius cut out with radius angle of approximately 180 degrees and with a diameter of first radius cut out greater than a diameter of an umbrella pole, and wherein said front edge of top retaining portion contains a second radius cut out with radius angle of approximately 180 degrees and with a diameter of second radius cut out greater than the diameter of the table umbrella pole, wherein said cut outs are positioned so said cut outs are rotated 180 degrees to each other and are concentric when viewed perpendicular to the lower base portion plane, further including removable radius cut out inserts that have an inside diameter that is equal to or slightly greater than the diameter of the umbrella pole and an outside diameter that is approximately equal to the inside diameter of the radius cut outs.

17. The detachable utility holder of claim 16 wherein the detachable utility holder is constructed from plastic.

18. The detachable utility holder of claim 16 wherein the detachable utility holder is constructed from metal.

19. The detachable utility holder of claim 16 wherein the radius inserts are constructed from plastic.

20. The detachable utility holder of claim 16 wherein the lower base portion between front and back edges form an enlarged planar surface capable of supporting dining items.

21. The detachable utility holder of claim 16 wherein the lower base portion is configured with a tubular female connector that would accept a plurality of attachments having a matching male connector.

* * * * *